US007425884B2

(12) United States Patent
Suzui

(10) Patent No.: US 7,425,884 B2
(45) Date of Patent: Sep. 16, 2008

(54) ELECTRICAL DEVICE AND METHOD OF PRODUCING THE SAME

(75) Inventor: Masaki Suzui, Kyoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/729,945

(22) Filed: Dec. 9, 2003

(65) Prior Publication Data

US 2004/0174240 A1 Sep. 9, 2004

(30) Foreign Application Priority Data

Dec. 11, 2002 (JP) ..... 2002-359477
Dec. 2, 2003 (JP) ..... 2003-403742

(51) Int. Cl.
*H01F 5/00* (2006.01)

(52) U.S. Cl. ..... 336/200; 336/223; 336/232

(58) Field of Classification Search ..... 336/174, 336/200, 223, 232, 205, 206, 83; 29/602.1, 29/606

See application file for complete search history.

(56) References Cited

U.S. PATENT DOCUMENTS 2,943,966 A * 7/1960 Leno et al. ..... 336/200
3,546,644 A * 12/1970 Michel et al. ..... 336/223
3,659,240 A * 4/1972 Learned et al. ..... 336/200
3,704,390 A * 11/1972 Grahame ..... 315/276
3,775,720 A * 11/1973 Winn ..... 336/69
4,159,457 A * 6/1979 Charpentier ..... 336/183
4,176,335 A * 11/1979 Charpentier ..... 336/180
4,206,434 A * 6/1980 Hase ..... 336/5
4,237,345 A * 12/1980 Dotter, Jr. ..... 379/341
4,621,231 A * 11/1986 Heinrich et al. ..... 324/142
4,651,254 A * 3/1987 Brede et al. ..... 361/248
4,694,283 A * 9/1987 Reeb ..... 340/572.5
4,933,657 A * 6/1990 Bessho et al. ..... 335/299
5,017,902 A * 5/1991 Yerman et al. ..... 336/83
5,134,770 A * 8/1992 Yerman et al. ..... 29/606
5,376,774 A * 12/1994 McGaffigan et al. ..... 219/624
5,495,213 A * 2/1996 Ikeda ..... 333/181
5,534,838 A 7/1996 Lindberg ..... 336/183
6,087,922 A * 7/2000 Smith ..... 336/223
6,160,467 A 12/2000 Teimorzadeh et al. ..... 336/180
6,346,865 B1 * 2/2002 Callewaert et al. ..... 333/185
6,493,246 B2 12/2002 Suzui et al. ..... 363/95
2003/0218888 A1 11/2003 Suzui et al.

FOREIGN PATENT DOCUMENTS

DE 100 40 415 C1 1/2002
EP 0 601 776 A1 6/1994
JP 2001 155933 6/2001

* cited by examiner

*Primary Examiner*—Anh T Mai
(74) *Attorney, Agent, or Firm*—Fitzpatrick, Cella, Harper & Scinto

(57) ABSTRACT

To form a center tap (CT), at least two coils must be formed. This increases the number of steps in the winding process and decreases the workability. To prevent this, a conductor having a plurality of plate portions that are connected to each other at one vertex of a rectangular shape is formed. The conductor is wound on a winding shaft, thus forming two coils.

7 Claims, 20 Drawing Sheets

ELECTRICAL DEVICE AND METHOD OF PRODUCING THE SAME

FIELD OF THE INVENTION

The present invention relates to an electrical device and a method of producing the same, e.g., to an electrical device such as a transformer or inductor.

BACKGROUND OF THE INVENTION

When a transformer having a center tap (CT) is used, for example, the number of switching elements of a power conversion circuit can be reduced. In a transformer, as shown in FIG. 1, a plurality of coils are formed by winding electric wires on a bobbin 11. The ends of the coils are connected to pin terminals 12 of the bobbin 11 to serve as input/output terminals. FIG. 2 shows a typical graphical symbol for a transformer having a CT. The terminal numbers coincide with those the circled terminal numbers shown in FIG. 1.

To form a CT, at least two coils must be formed. This leads to an increase in number of steps in the winding process and a decrease in workability. When one end of each coil is connected to a common pin terminal in order to form the CT, the workability decreases more. The increase in number of steps and the decrease in workability increase the production cost of the transformer, and make it difficult to automate the production of the transformer.

In a transformer which deals with a large current, sometimes a plurality of coils are formed and used as they are connected parallel to each other, so that the resistance of the coils may be decreased. To form a CT, at least two coils are required. To form coils of a transformer having a CT to be parallel to each other, coils in a number twice that of the coils of a transformer having no CT must be formed by winding. This further increases the production cost of the transformer and makes it further difficult to automate the production of the transformer.

Japanese Patent Laid-Open No. 2001-155933 discloses a transformer that uses a plate-like coil on which a plate-like conductor (to be referred to as a "conductive plate" hereinafter) is wound, in order to reduce the number of producing steps of the transformer that deals with a large current. As the conductive plate is formed by pressing or the like, a plate material loss occurs easily when forming the conductive plate by punching. Also, the conductive plate is difficult to machine when compared to an ordinary electric wire. Thus, a plate-like coil is not applied to a transformer with a CT in which the coil has a complicated arrangement.

SUMMARY OF THE INVENTION

The present invention has been made to solve the above problems separately, or at once, and has as its object to facilitate formation of coils having a tap, thus improving the workability. It is another object of the present invention to provide coils with a low resistance without forming a plurality of windings parallel to each other.

In view of the above objects, a preferred embodiment of the present invention discloses an electrical device comprising: a conductor in which a plurality of plate portions are connected to each other at portions thereof; and at least two coils on which the conductor is wound.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Electrical devices according to the embodiments of the present invention will be described in detail with reference to the accompanying drawings.

[Outline]

According to the embodiment, a conductor in which a plurality of plate portions are connected to each other at their portions is formed. The conductor is wound to form at least two coils. The connecting portion of th plate portions is utilized as the tap of the coils, or as the center tap of a transformer. The plate portions to be connected to each other are point-symmetrical with respect to their connecting portion.

[Arrangement]

The characteristic feature of the transformer of the embodiment resides in the coil arrangement having a CT. A description will be made mostly on the coil arrangement.

Figure 3:
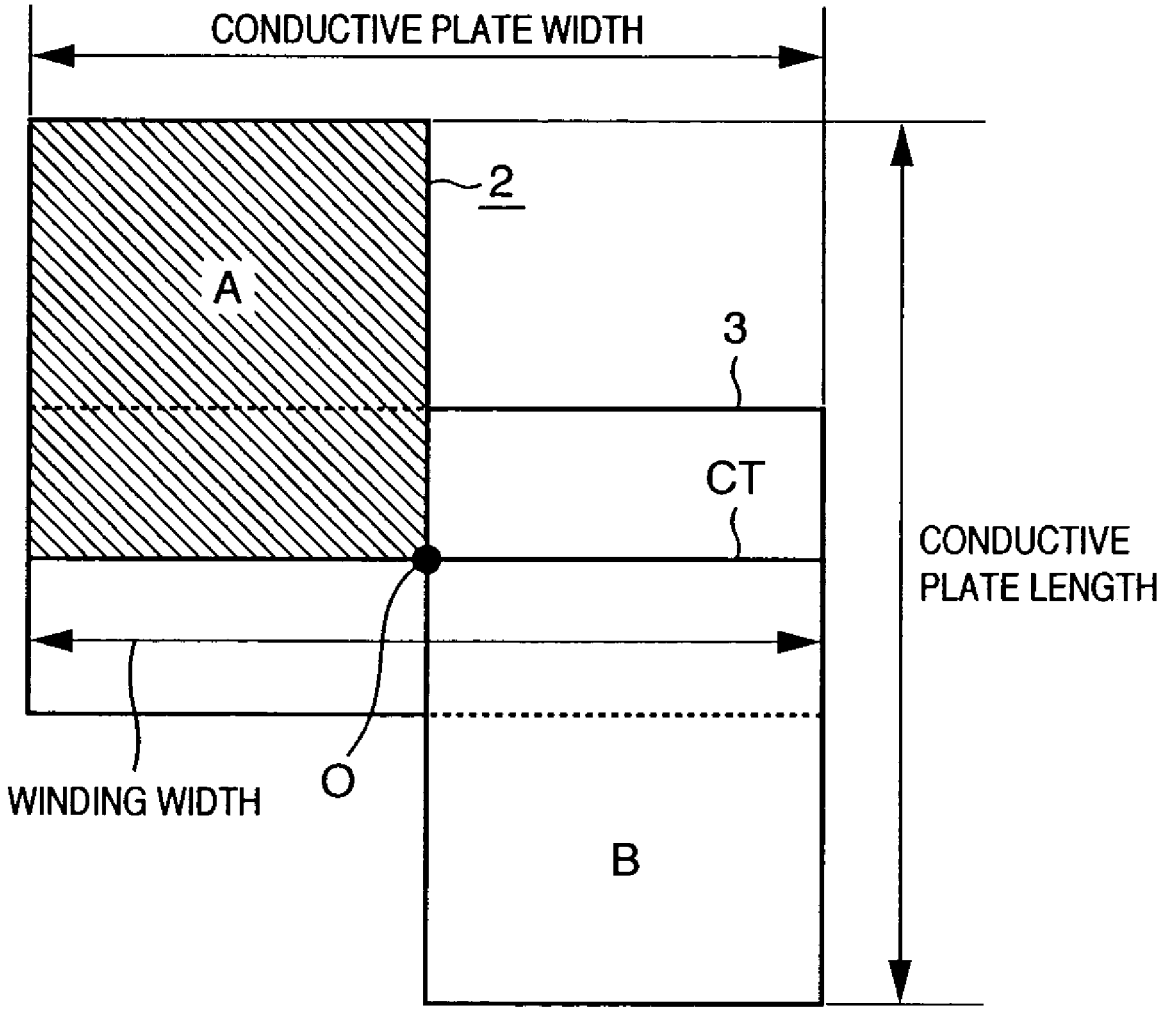
FIG. 3 is a view showing the shape of a conductive plate that forms the coils of a transformer according to an embodiment.

FIG. 3 is a view showing the shape of a conductive plate 2 which forms the coils of the transformer according to the embodiment.

A winding shaft 3 is a winding shaft on which the conductive plate 2 or an electric wire is to be wound to form the coils. The winding shaft 3 has a hollow shape such as a cylinder so that a magnetic core can be inserted in it when necessary. A direction perpendicular to the section of the cylinder of the winding shaft 3 will be defined as the "direction of the winding width", and the length of the winding shaft 3 in the direction of the winding width will be defined as the "winding width".

The conductive plate 2 is a single plate of a conductor having a point O as its center. The conductive plate 2 has a set of rectangular flat plate portions A and B to be point-symmetrical with respect to the point O. One side of the flat plate portion A and one side of the flat plate portion B, which are parallel to the direction of the winding width and include the point O, constitute the CT. The length of the conductive plate 2 parallel to the direction of the winding width will be defined as the "conductive plate width", and the length of the conductive plate 2 in a direction perpendicular to the direction of the winding width will be defined as the "conductive plate length".

To utilize the winding width to the maximum, the conductive plate width is set equal to or slightly smaller than the winding width, as shown in FIG. 3. For the same reason, the flat plate portions A and B are rectangular. For the sake of descriptive convenience, the coils which are formed from the conductive plate will be described as the primary coils of the transformer.

Figure 8:
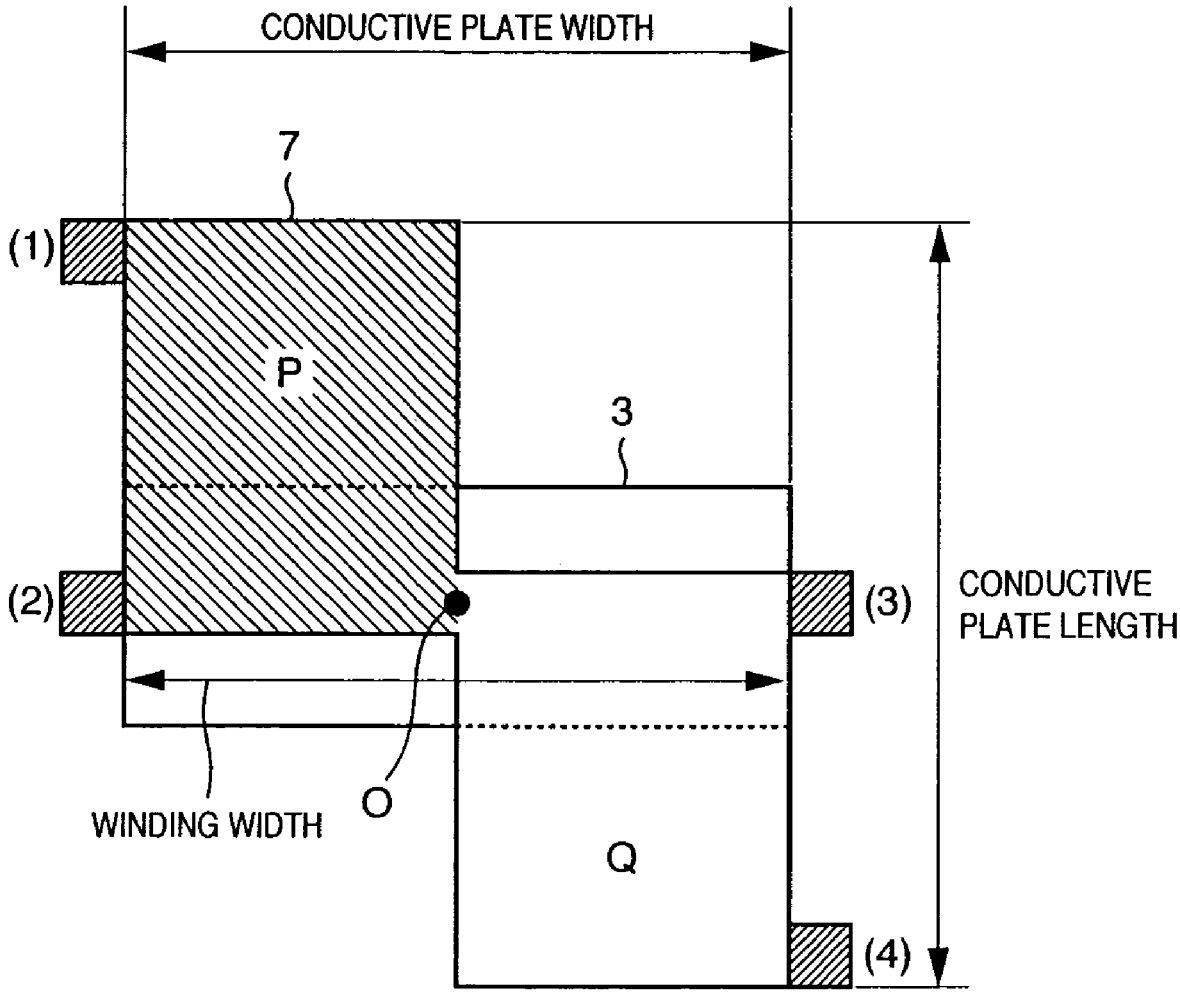
FIG. 8 is a view showing the shape of a conductive plate according to the first embodiment.

In FIG. 3, the flat plate portions A and B are connected to each other at their portions, that is, at one vertex of each flat plate portion. Even if the connecting portion forms a CT having a predetermined width, as shown in FIG. 8 which will be described later, the two plate portions will be regarded to be substantially connected to each other at the vertices of the respective flat plate portions.

Figure 4:
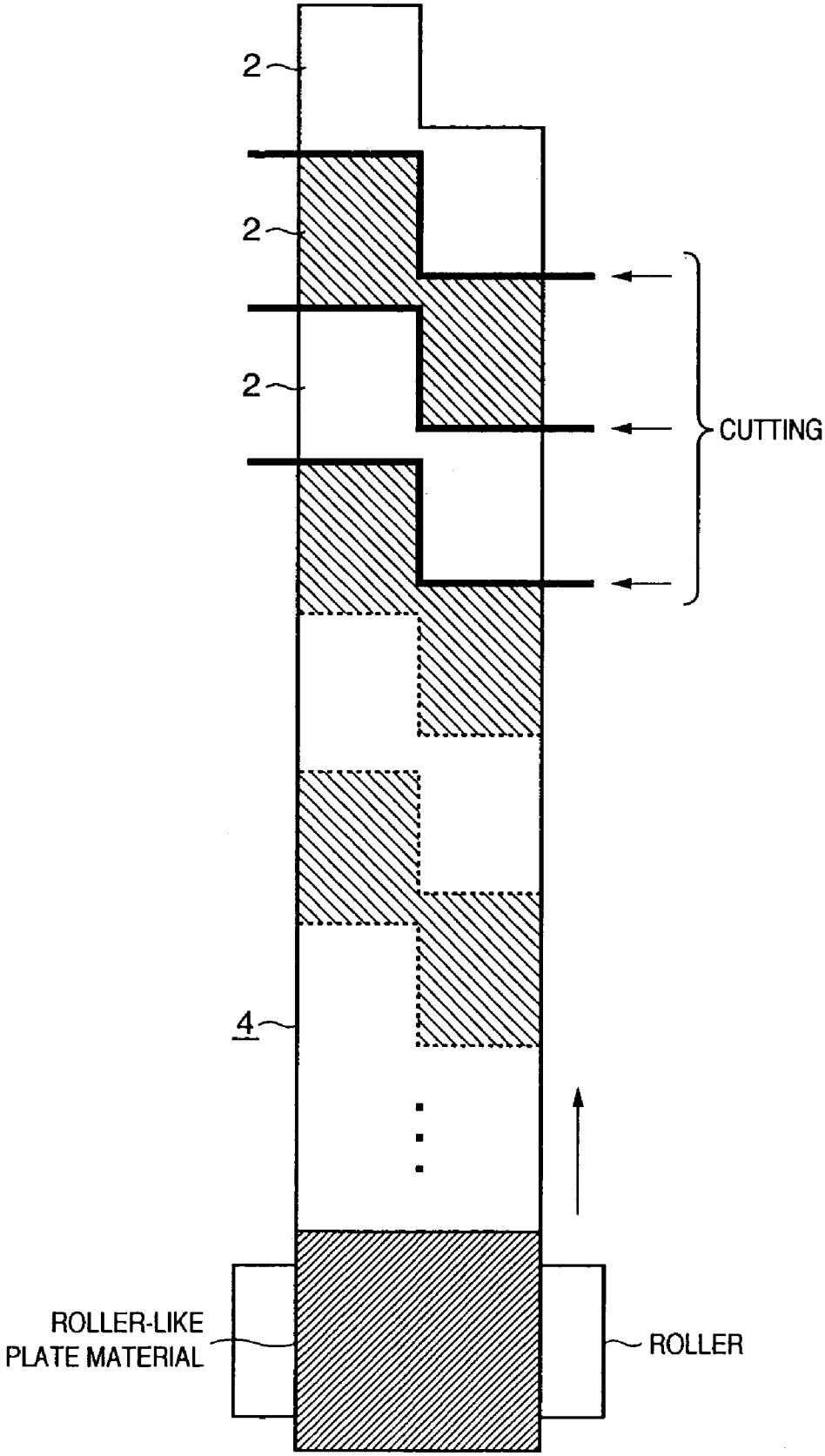
FIG. 4 is a view for explaining a method of producing the conductive plate.

FIG. 4 is a view for explaining a method of producing the conductive plate 2.

As shown in FIG. 4, a plate material 4 is a plate of a conductor having the same width as the conductive plate width of the conductive plate 2. The plate material 4 which forms a roll is continuously cut, while it is being extended, into the shape of the conductive plate 2, and an insulating covering material is applied to the obtained plate, to complete the conductive plate 2. For cutting, for example, a laser cutter, pressing, or the like is used. According to this method, the conductive plat 2 can be produced easily. Also, when forming the conductive plates 2 by cutting, the plate material 4 will not produce any waste.

Figure 5:
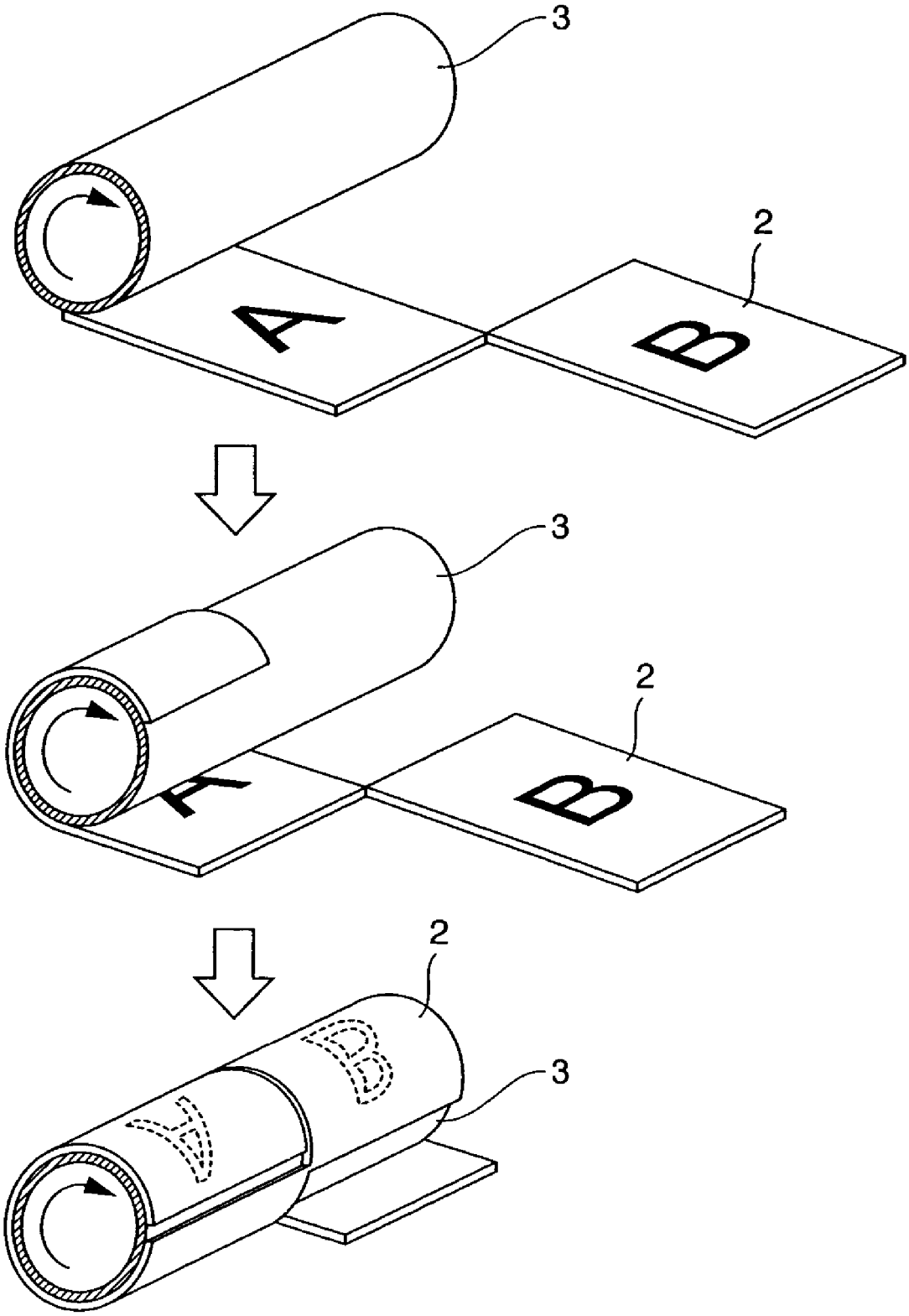
FIG. 5 is a view for explaining a method of forming coils with a conductive plate.

FIG. 5 is a view for explaining a method of forming coils with the conductive plate 2.

First, that side of the flat plate portion A of the conductive plate 2 which is opposite to the side that forms the CT is fixed to the winding shaft 3. The winding shaft 3 is rotated in the direction of an arrow shown in FIG. 5, so that the conductive plate 2 is wound on the winding shaft 3. In this case, the conductive plate 2 is wound such that it will not extend over the winding width of the winding shaft 3 and that the flat plate portions A and B will not be twisted, thus forming two coils.

Figure 6:
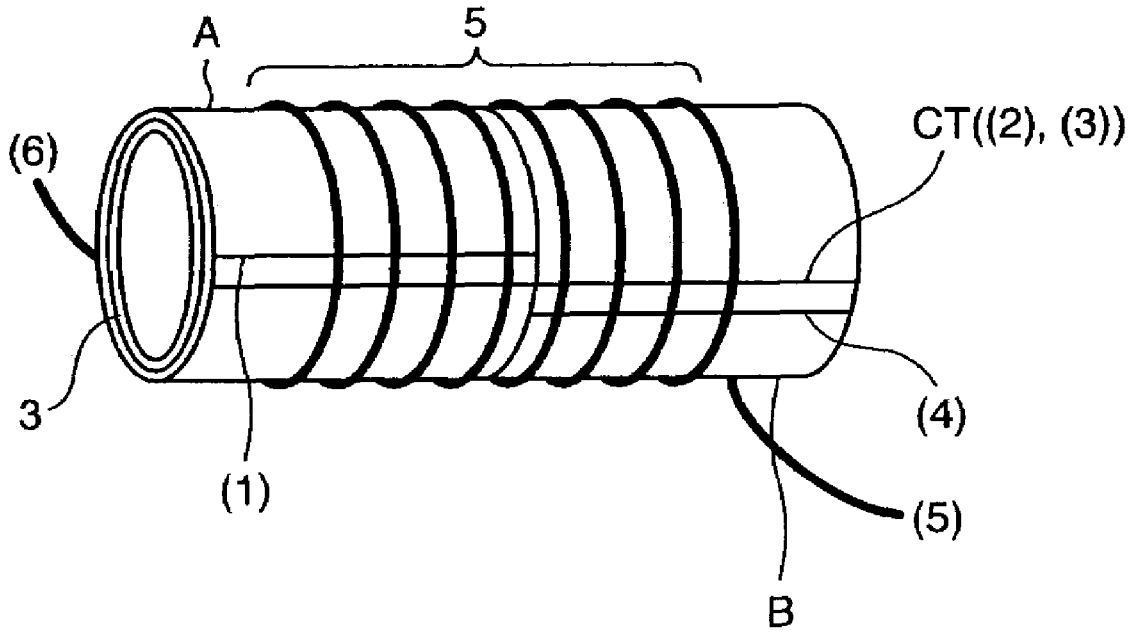
FIG. 6 is a view showing the coils in a completed state.
Figure 7:
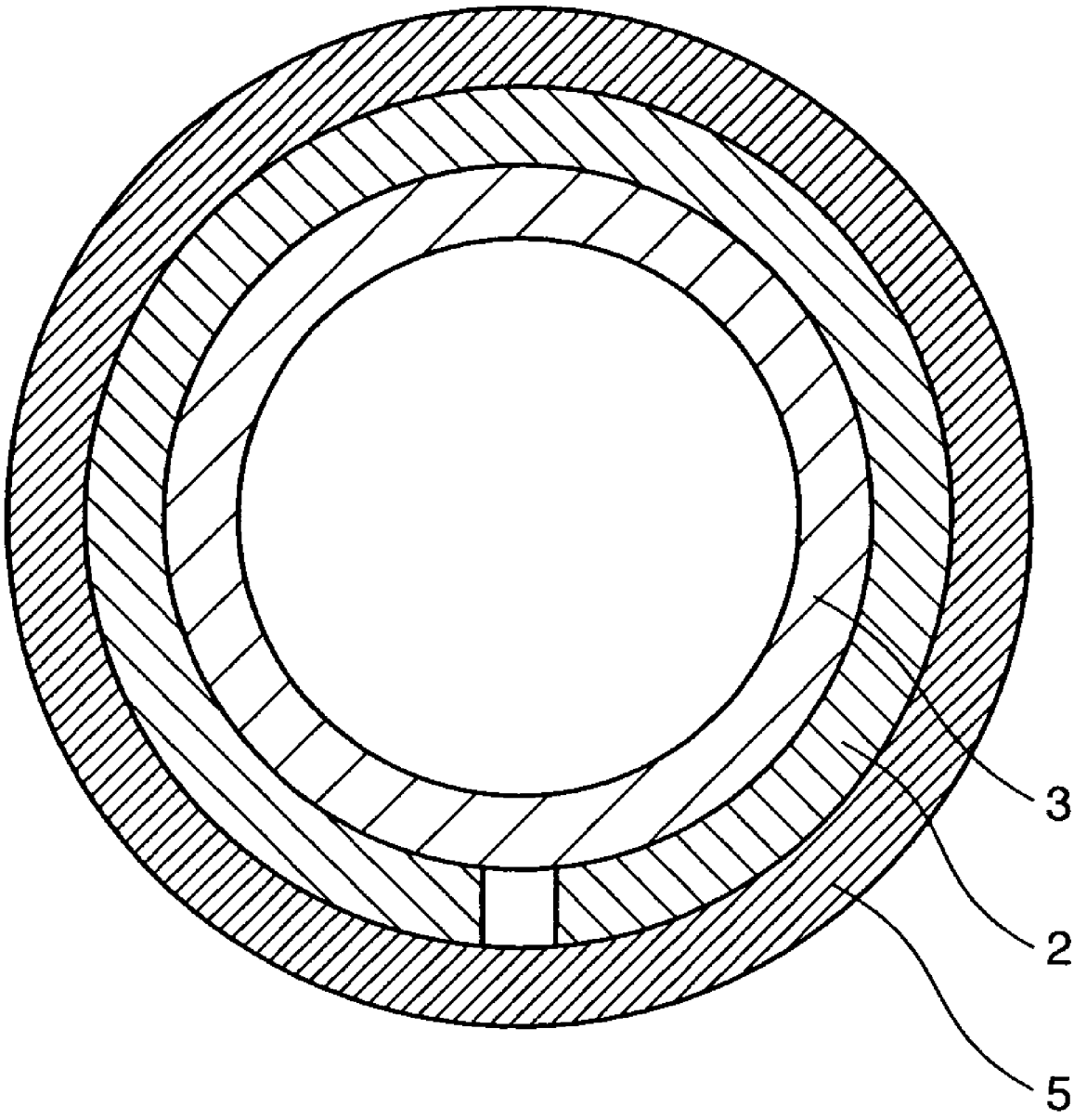
FIG. 7 is a sectional view of the coils in the completed state.

FIG. 6 is a view showing the coils in a completed state, and FIG. 7 is a sectional view of the coils in the completed state.

Figure 1:
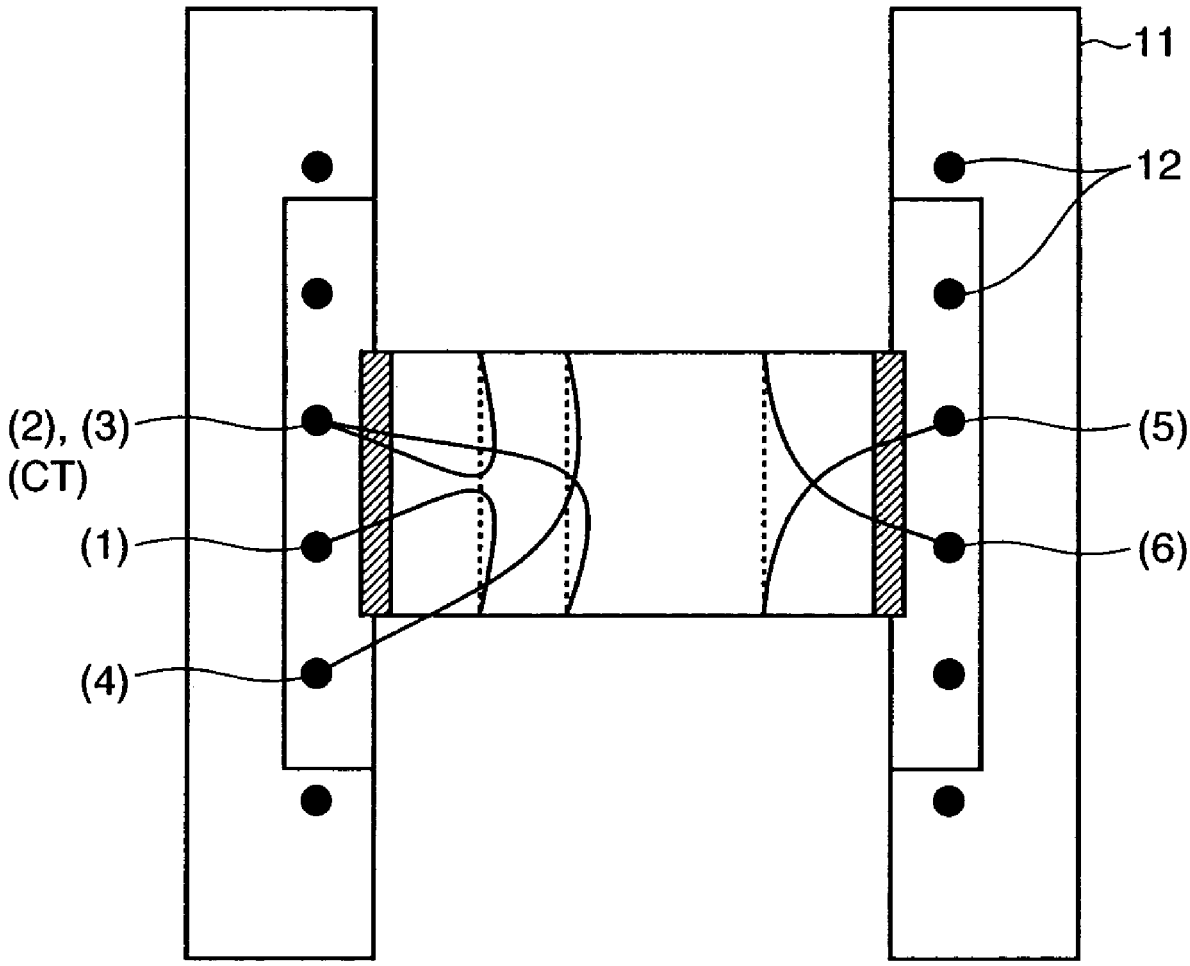
FIG. 1 is a view for explaining a method of producing a transformer.
Figure 2:
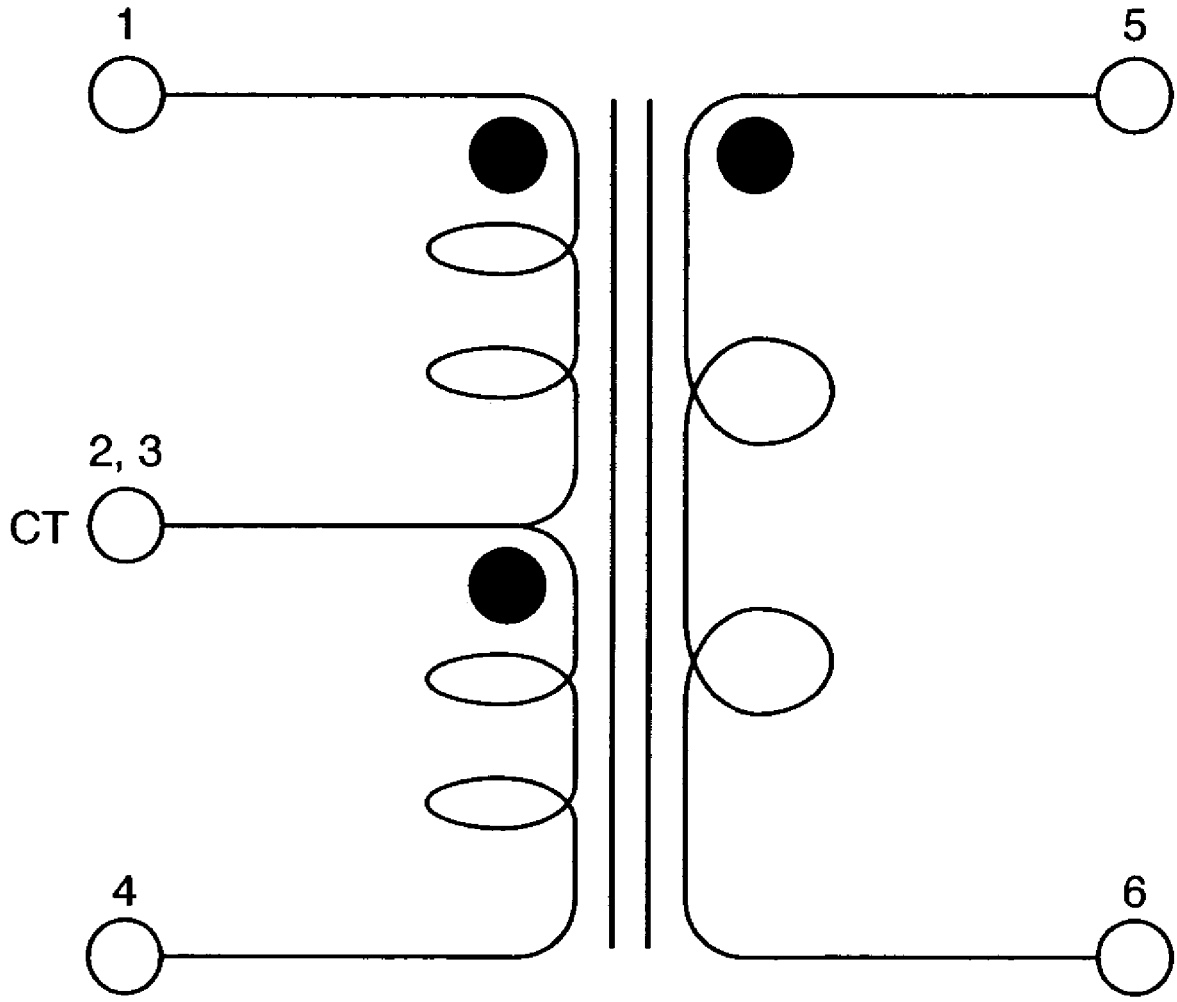
FIG. 2 is a diagram showing a typical graphical symbol for a transformer having a CT.

As shown in FIGS. 6 and 7, electric wires are wound on the outer surfaces of the flat plate portions A and B of the conductive plate 2 to form a secondary coil 5. The conductive plate 2 which forms the primary coils is flat. Thus, it is easy to wind the secondary coil on the outer surfaces of the primary coils. It is also easy to so wind the conductive plate 2 on the secondary coil as to cover it. The terminal numbers circled in FIG. 6 coincide with the terminal numbers of the reference numerals shown in FIG. 2.

In this manner, the primary coils of the transformer according to this embodiment can be formed easily by winding one conductive plate 2, obtained from the plate material 4 by cutting, on the winding shaft 3. Therefore, the winding process is simplified, and the workability is improved. Operation such as leading electric wires to terminals in order to form a CT is unnecessary, thus improving the workability. Consequently, the production cost of the transformer is reduced, and the production of the transformer can be automated easily.

As the primary coils are formed by effectively using the winding width of the winding shaft 3, the resistances of the primary coils can be reduced easily. If the primary coils are arranged to be in contact with the winding shaft 3, the lengths of the primary coils become minimum. This contributes to a decrease in resistances of the primary coils. Therefore, in each primary coil of the transformer according to this embodiment, a measure that increases the number of steps in the winding process and hence decrease the workability, i.e., forming a plurality of coils parallel to each other, becomes unnecessary.

As the plate material 4, a copper plate is preferable. Alternatively, other metal plates having sufficient conductivity, e.g., an aluminum plate, can be used. A laminated plate in which a thin conductive film and a nonconductive film are stacked alternately can also be used. When such a thin, conductive film is used, an eddy current in the direction of the thickness of the plate material, which is caused by an alternating field formed by the primary coils or other factors, can be decreased by decreasing the thickness of the plate material, thus decreasing the loss. Also, an AC resistance caused by the skin effect can be decreased.

If insulation between the flat plate portions A and B after winding can be ensured by, e.g., including an insulator between them, no insulating covering need be applied to the conductive plate 2 after cutting.

First Embodiment

FIG. 8 is a view showing the shape of a conductive plat 7 according to the first embodiment.

The conductive plate 7 has a set of flat plate portions P and Q, and terminals (or electrodes; terminal numbers are circled in FIG. 6) at their ends. The flat plate portion P is a rectangular flat plate which forms a coil P, and has terminals 1 and 2. The flat plate portion Q is a rectangular flat plate which forms a coil Q, and has terminals 3 and 4. The terminals 2 and 3 correspond to a CT, and are all arranged at positions outside the winding width. In more detail, of the four corners of the flat plate portions P and Q, the terminals 1 and 4 are arranged at corners that are diagonal with respect to the center O, and the terminals 2 and 3 are arranged at corners shifted from the center O in the direction of the winding width. The conductive plate 7 is designed such that its conductive plate width almost coincides with the winding width and that only its terminals project from the winding width.

Figure 9:
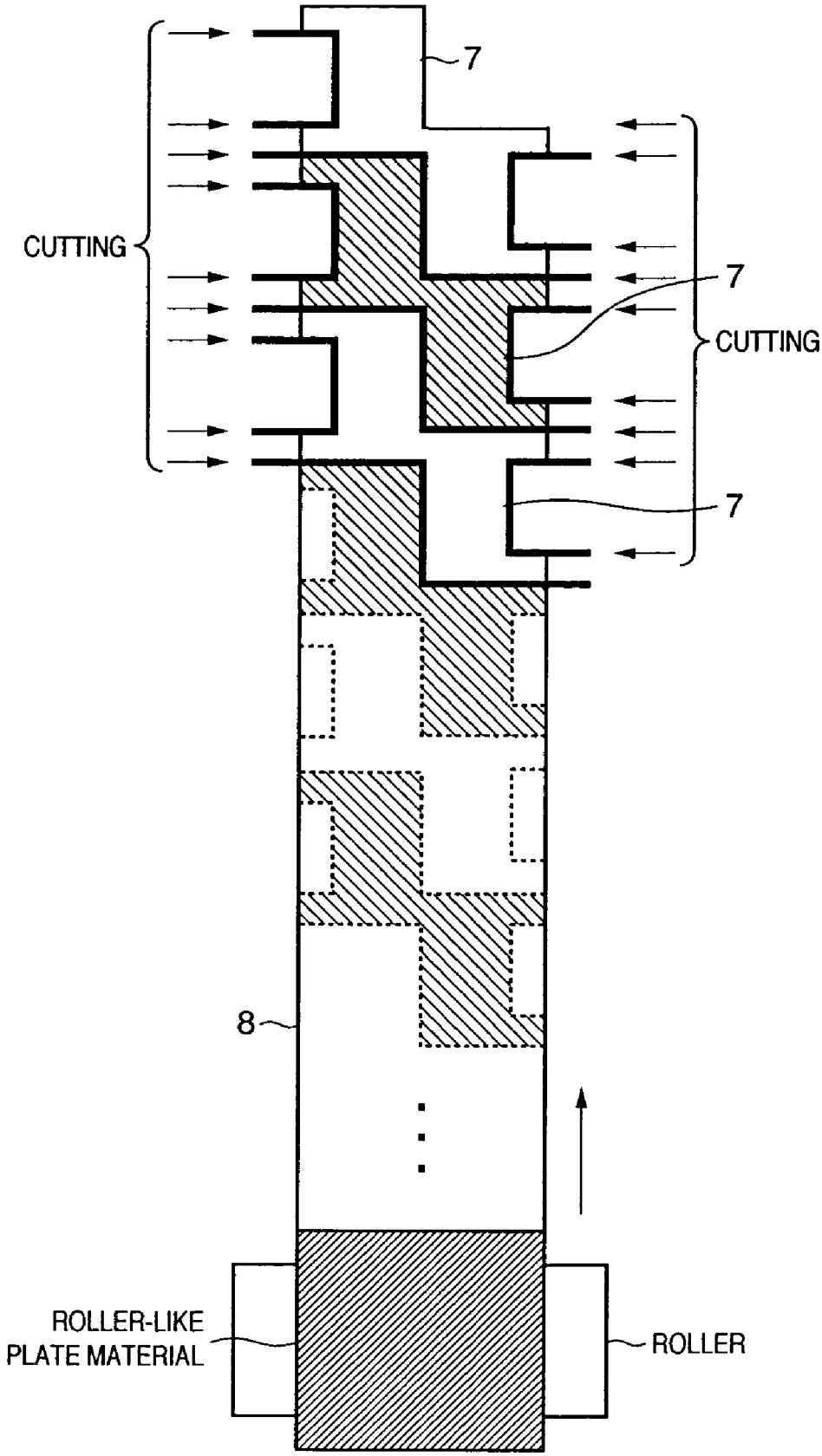
FIG. 9 is a view for explaining a method of producing the conductive plate according to the first embodiment.

FIG. 9 is a view for explaining a method of producing the conductive plate 7.

In the same manner as the conductive plate 2, a plate material 8 which forms a roll is continuously cut, while it is being extended, into the shape of the conductive plate 7, and an insulating covering material is applied to the obtained plate, to complete the conductive plate 7. When applying the insulating covering material, the terminal portions are left uncovered. Alternatively, after application, the covering is removed.

Figure 10:
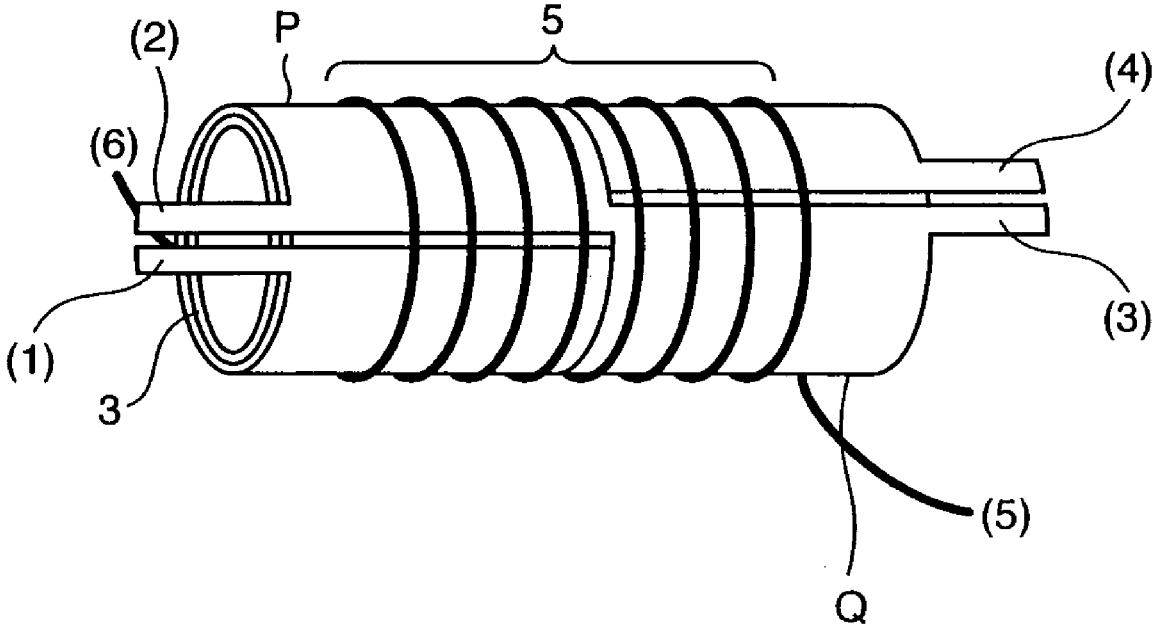
FIG. 10 is a view showing coils according to the first embodiment in a completed state.

FIG. 10 is a view showing coils in a completed state.

The conductive plate 7 is wound on a winding shaft 3, in the same manner as in the coil forming method shown in FIG. 5, to complete coils having terminals. To ensure insulation distances between the adjacent terminals 1 and 2, and between the terminals 3 and 4, a small gap is provided between the winding start and winding end of each of the flat plate portions P and Q. If those portions of the flat plate portions P and Q where the terminals are in contact with each other are insulated by covering, the gaps can be omitted. When the coils shown in FIG. 10 are to be attached to a printed board for an electrical circuit or the like, if the respective terminals are bent and are inserted in a plurality of holes such as through holes formed in the printed board, the workability is improved. When the flat plate portions P and Q are wound, they may partly overlap, and consequently the terminals 2 and 4 at the winding end positions may overlap the terminals 1 and 3 at the winding start positions of the conductive plate 7. This is acceptable as far as insulation between the terminals is ensured.

Second Embodiment

Figure 11:
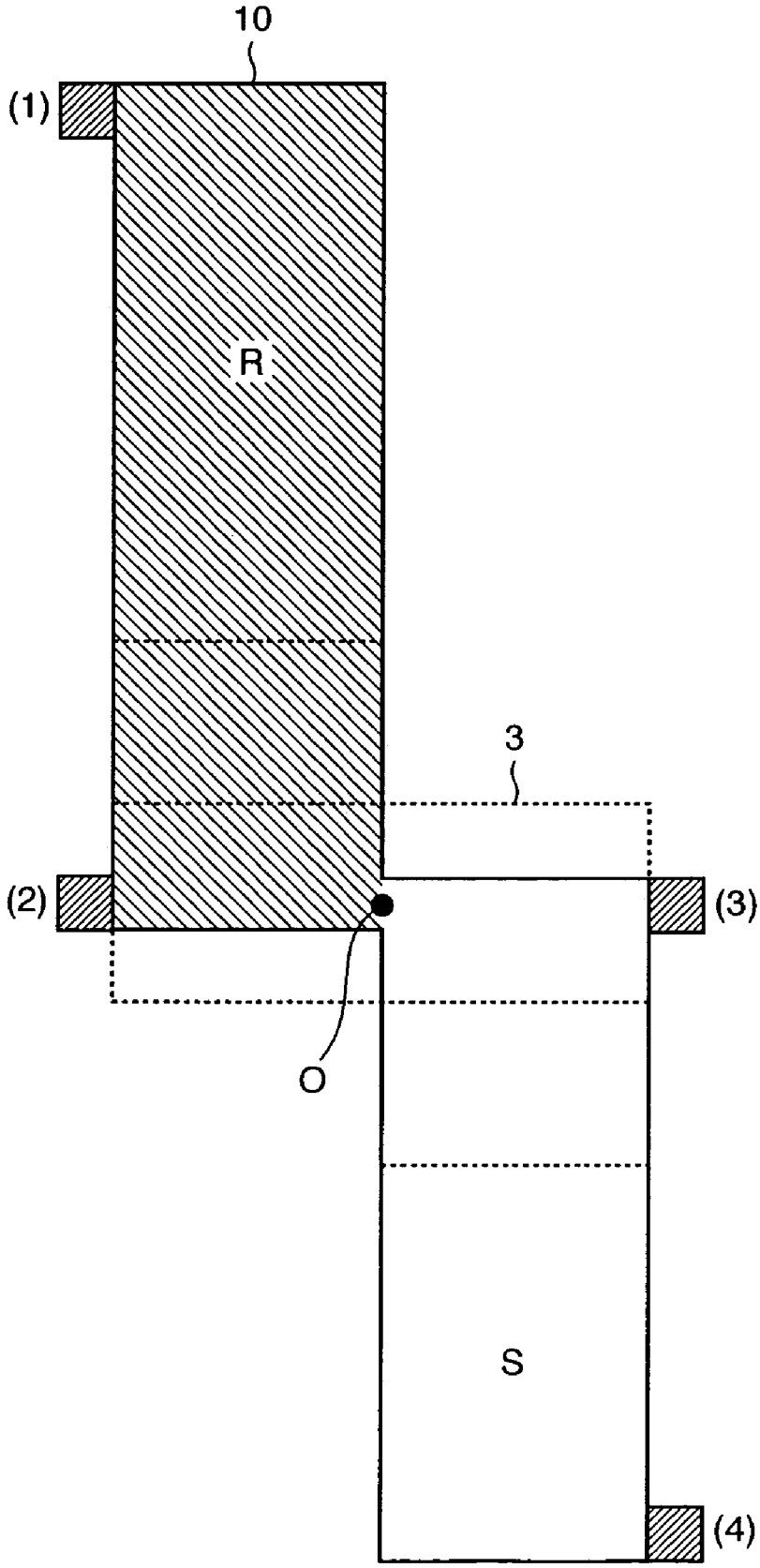
FIG. 11 is a view showing the shape of a conductive plate according to the second embodiment.

Coils in which each primary coil has two turns will be described as the second embodiment. FIG. 11 is a view showing the shape of a conductive plate 10 according to the second embodiment.

A conductive plate 10 has a set of flat plate portions R and S, and terminals (terminal numbers are circled in FIG. 11) at their ends. The flat plate portion R is a rectangular flat plate which forms a coil R, and has terminals 1 and 2. The flat plate portion S is a rectangular flat plate which forms a coil S, and has terminals 3 and 4. The positions of the terminals and the like are the same as in the first embodiment. The conductive plate 10 has such a winding length that it can be wound on a winding shaft 3 by two turns.

Figure 12:
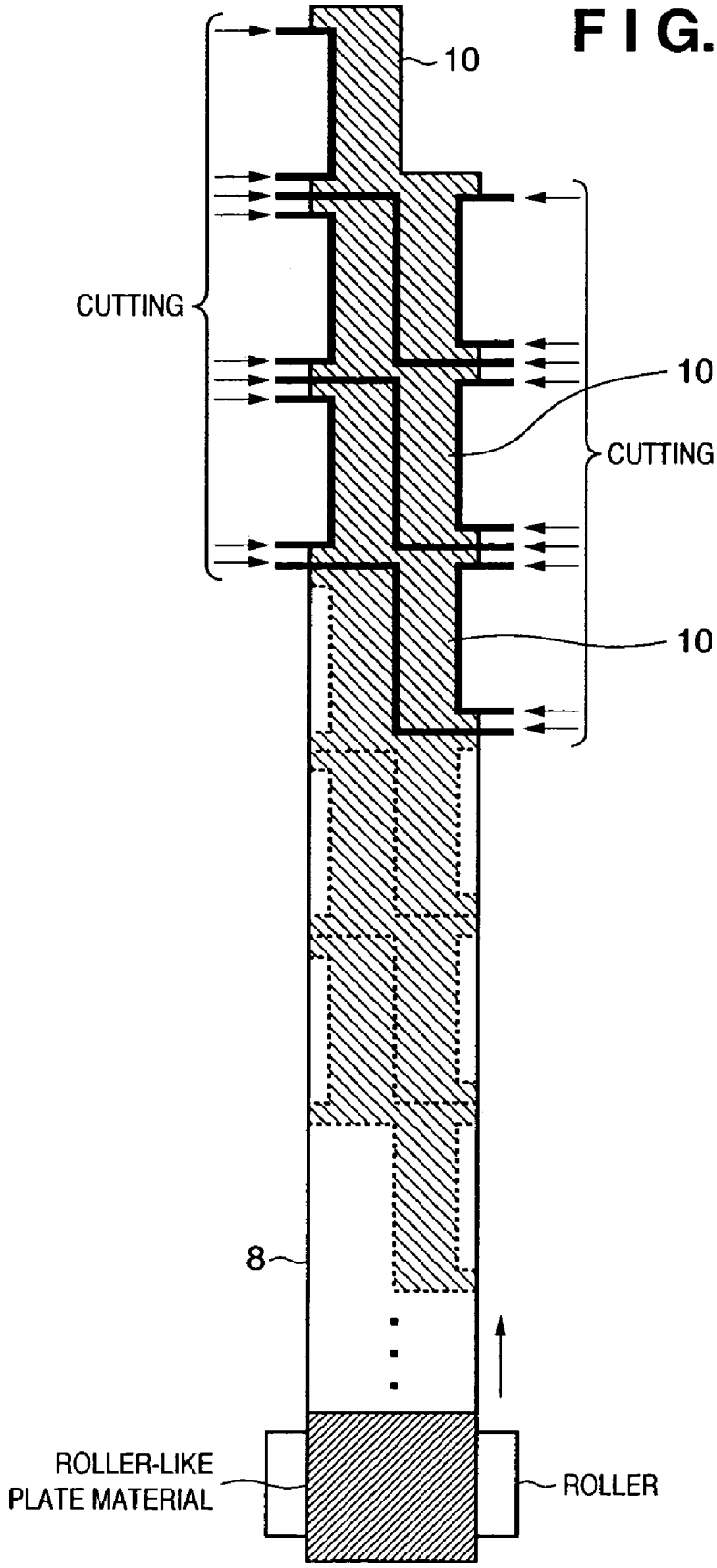
FIG. 12 is a view for explaining a method of producing the conductive plate according to the second embodiment.

FIG. 12 is a view for explaining a method of producing the conductive plate 10.

In the same manner as in the first embodiment, a plate material 8 is continuously cut into the outer shape of the conductive plate 10, and an insulating material is applied to the obtained plate, to complete the conductive plate 10.

When such a conductive plate 10 is wound on the winding shaft 3, coils each having two turns can be formed of the flat plate portions R and S. When the winding lengths of the flat plate portions R and S are increased, coils having arbitrary numbers of turns can be formed, e.g., coils having three or more turns, regardless of the numbers of turns of the coils.

Figure 19:
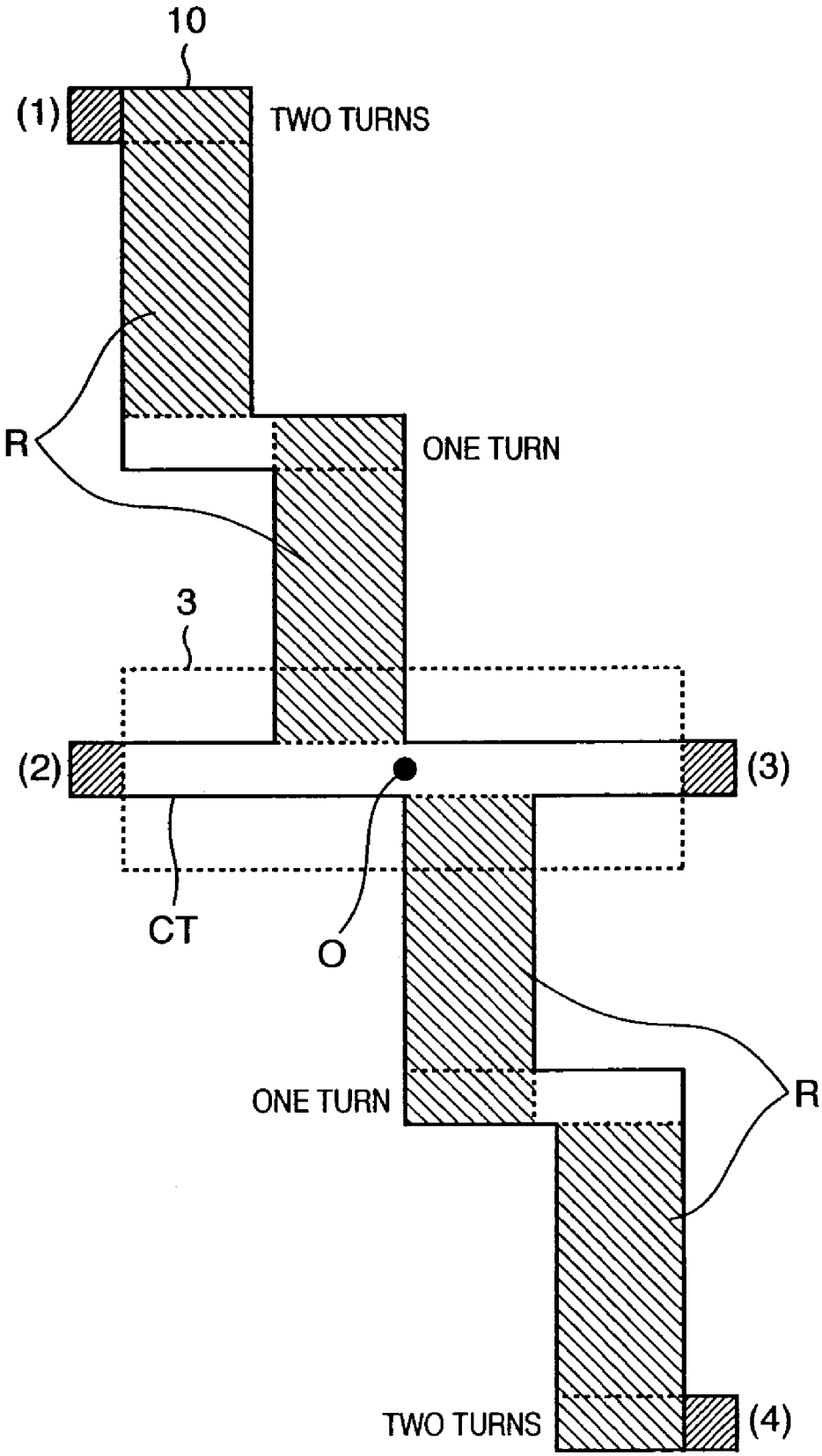
FIG. 19 is a view for explaining an example of the shape of another conductive plate according to the third embodiment.

As shown in FIG. 19, the plate portions of the respective coils each having a plurality of number of turns can be arranged such that their windings will not overlap. Then, the entire surfaces of the plate portions that form the primary coils can be in contact with the secondary coil, so that coupling of the transformer is improved.

Figure 20:
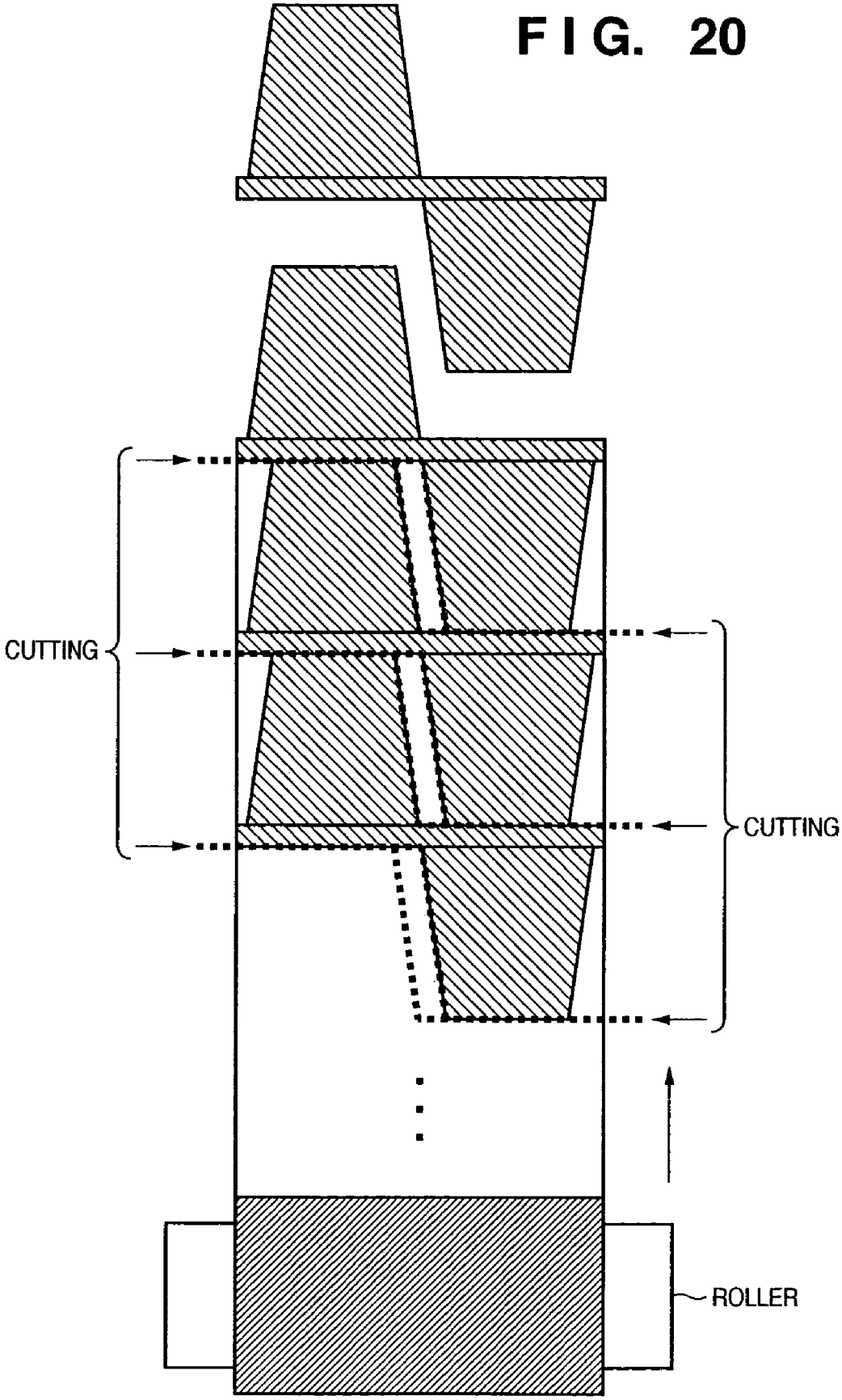
FIG. 20 is a view showing trapezoidal plate portions.

In the present invention, the shapes of the plate portions are not limited to rectangular shapes. Even when the plate portions are trapezoidal, as shown in FIG. 20, the present invention can be applied without any problem.

Third Embodiment

Figure 13:
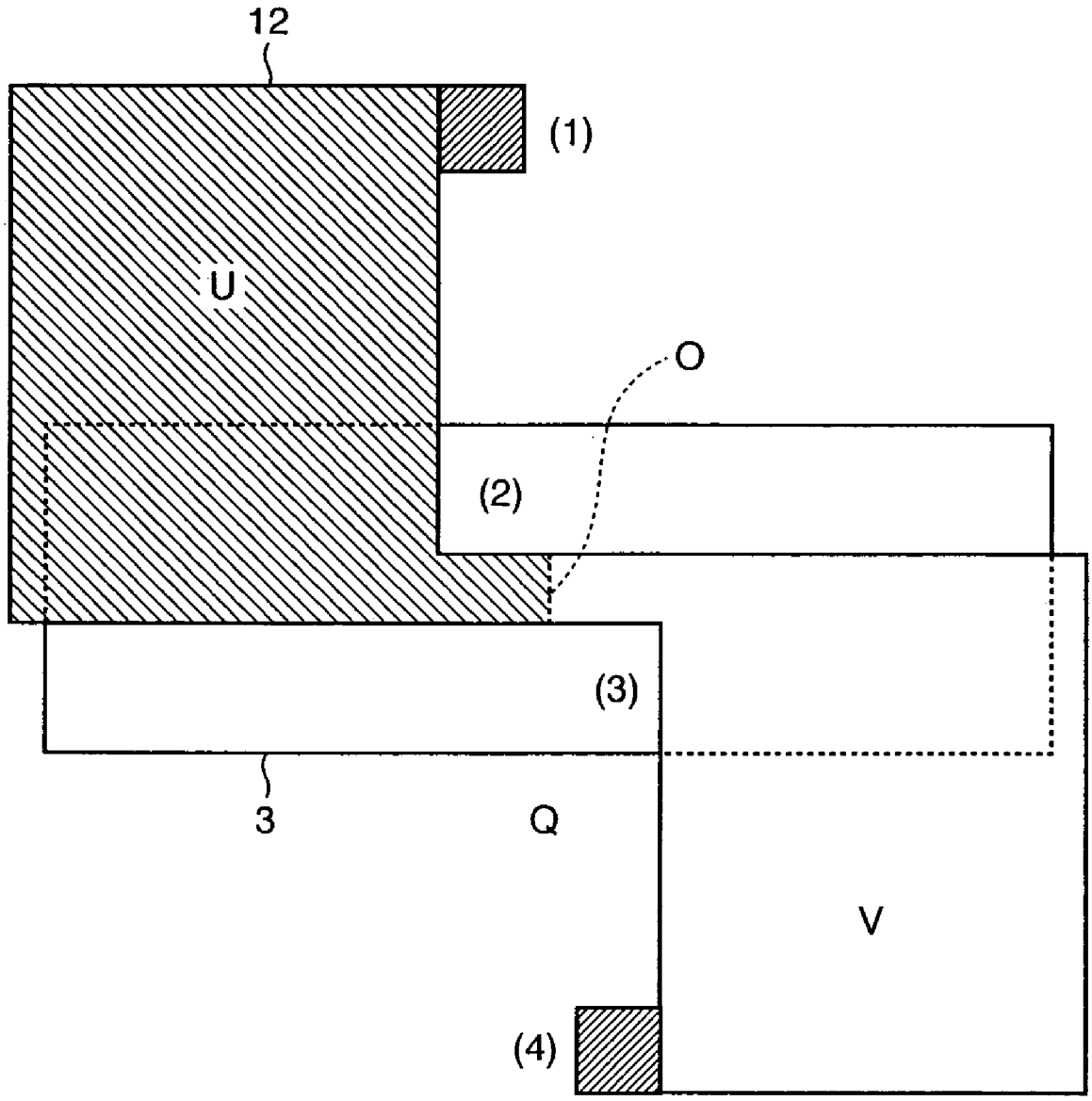
FIG. 13 is a view showing the shape of a conductive plate according to the third embodiment.
Figure 14:
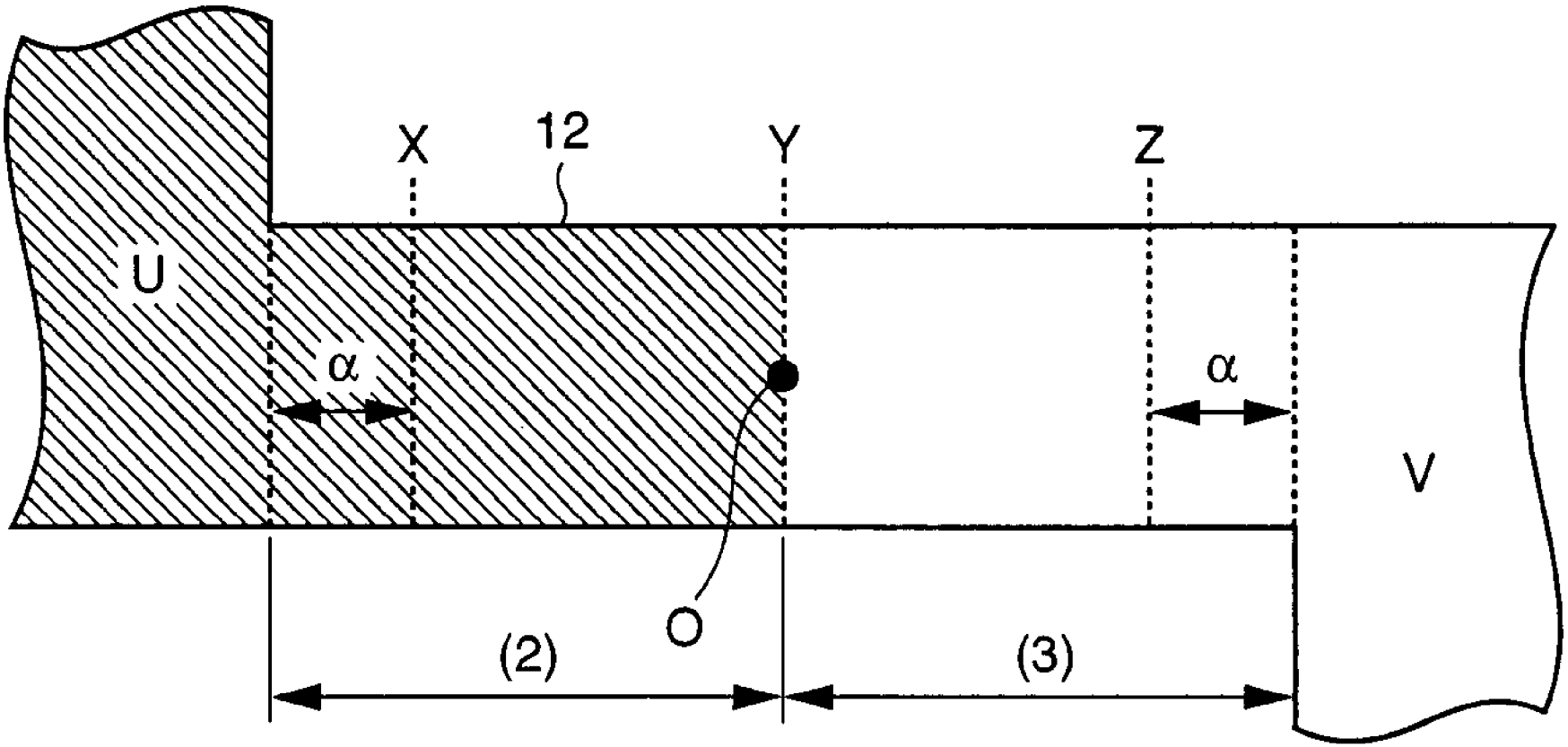
FIG. 14 is an enlarged view of the vicinity of a CT formation portion according to the third embodiment.

FIG. 13 is a view showing the shape of a conductive plate 12 according to the third embodiment, and FIG. 14 is an enlarged view showing the vicinity of terminals 2 and 3.

In the first and second embodiments, all the terminals of the conductive plate are arranged outside the winding width. In the third embodiment, the terminals of the conductive plate 12 are arranged in the vicinity of the center of the winding width.

The conductive plate 12 has a set of flat plate portions U and V, and terminals (terminal numbers are circled in FIG. 13) at their ends. The flat plate portion U is a rectangular flat plate which forms a coil U, and has terminals 1 and 2. The flat plate portion V is a rectangular flat plate which forms a coil V, and has terminals 3 and 4. The terminals 2 and 3 correspond to a CT.

As shown in FIGS. 13 and 14, the terminals 2 and 3 are arranged at the connecting portion of the flat plate portions U and V including a center O. The terminals 1 and 4 are arranged at corners shifted from the terminals 2 and 3 in the direction of the conductive plate length. The terminals are bent at substantially right angles at their bases immediately before winding. This will be described later in detail.

Figure 15:
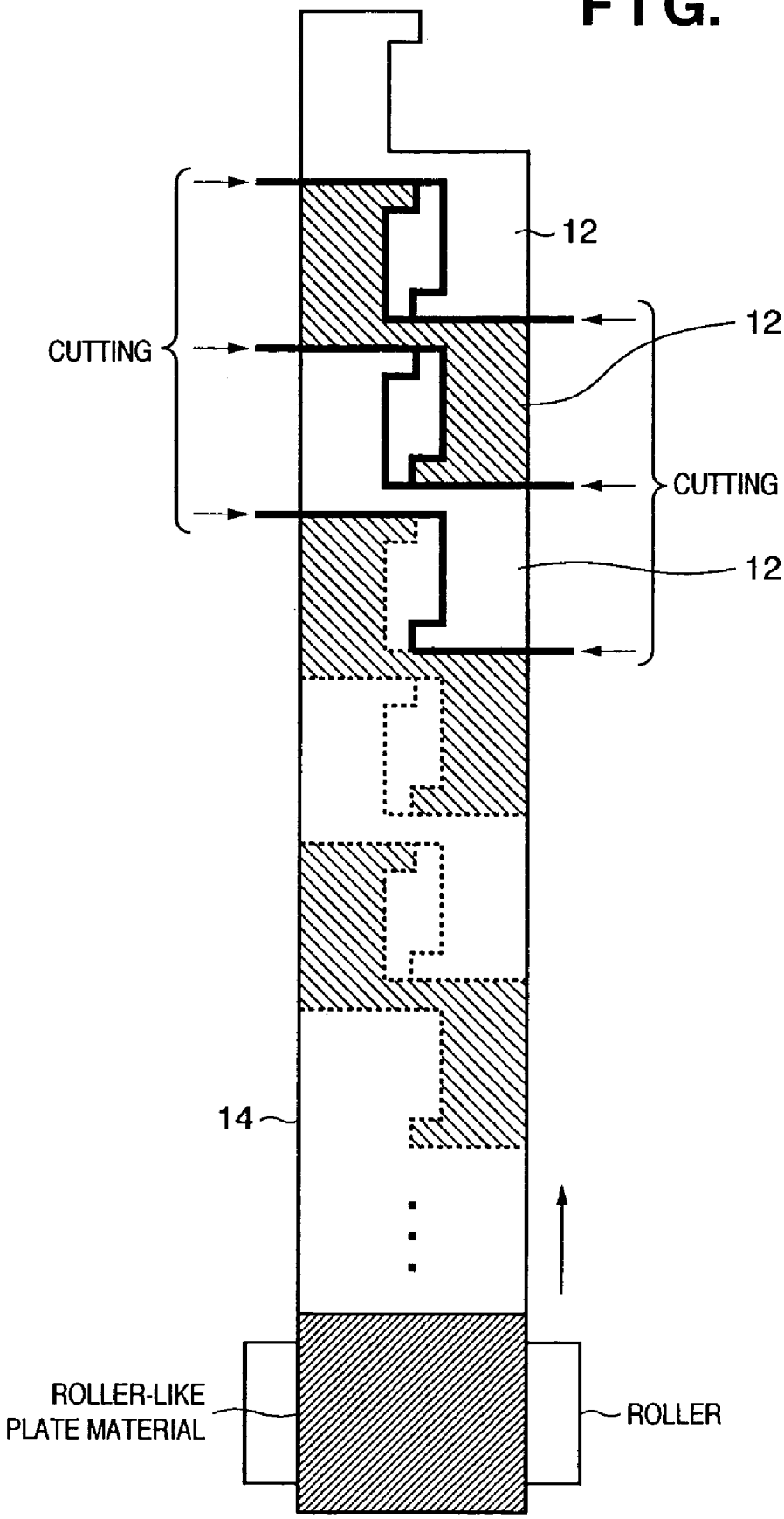
FIG. 15 is a view for explaining a method of producing the conductive plate according to the third embodiment.

FIG. 15 is a view for explaining a method of producing the conductive plate 12.

In the same manner as in the first and second embodiments, a plate material 14 is cut along the outer shape of the conductive plate 12. An insulating material is applied to the obtained plate, to complete the conductive plate 12.

Figure 16A:
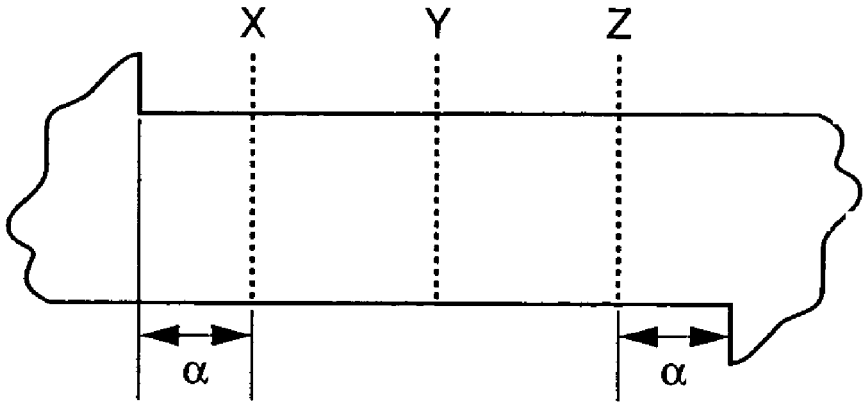
FIGS. 16A to 16C are views for explaining a method of forming the CT according to the third embodiment.
Figure 16B:
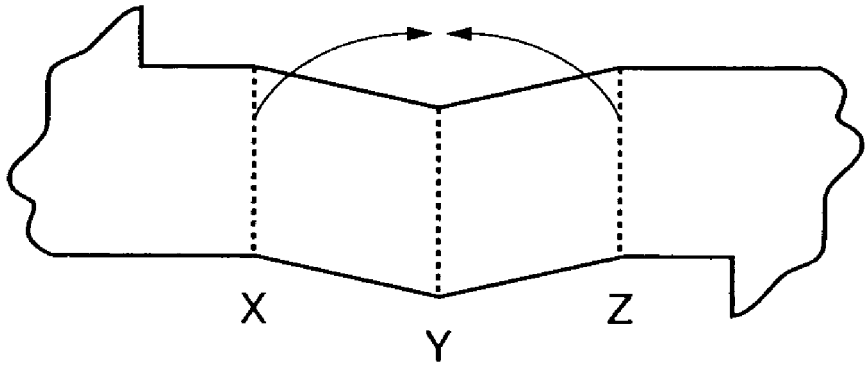
Figure 16C:
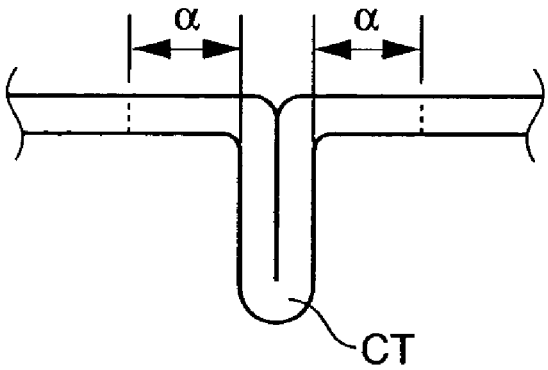

FIGS. 16A to 16C are views for explaining a method of forming the CT.

The connecting portion of the terminals 2 and 3 is bent upward or downward (see FIG. 16B) at positions (positions on straight lines X and Z) away from the bases of the terminals 2 and 3 each by a distance $\alpha$ about a straight line Y extending through the center 0 of the conductive plate as the center (see FIG. 16A). As a result, the flat plate portions U and V form a substantially upright CT having the straight line Y portion as its ridge line (see FIG. 16C). The conductive plate width of the conductive plate 12 is set large by considering the bending margin, so that after bending, the conductive plate width substantially coincides with the winding width of the winding shaft 3.

Figure 17:
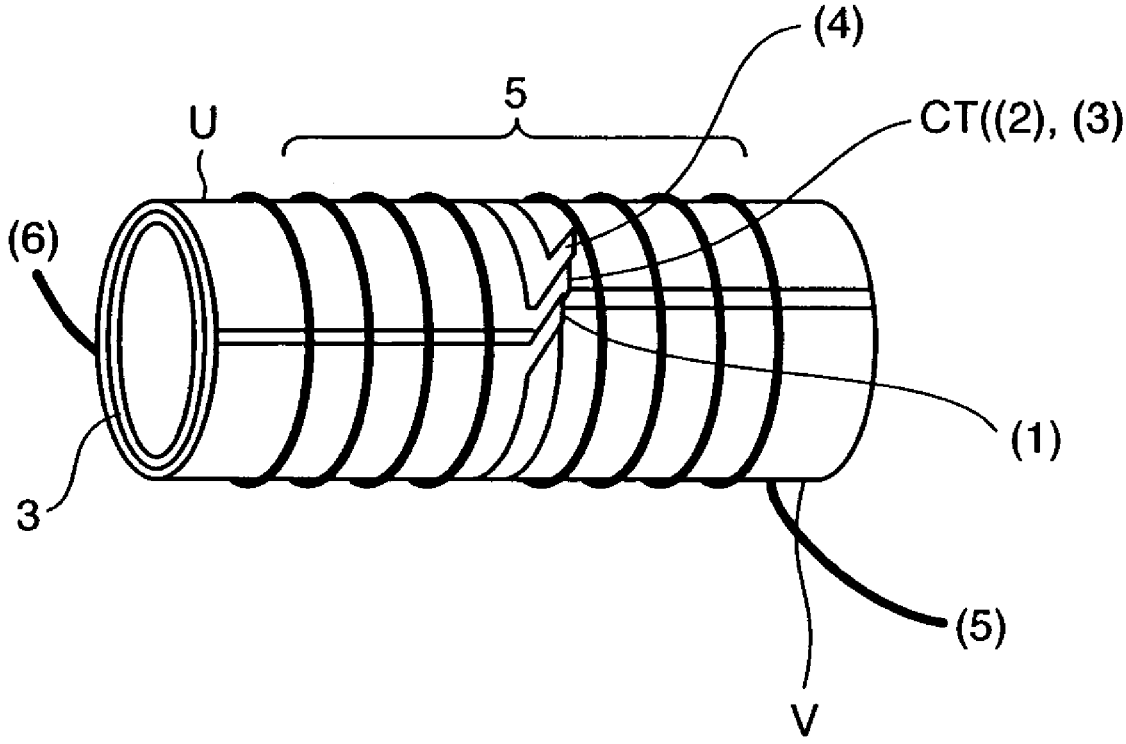
FIG. 17 is a view showing coils according to the third embodiment in a completed state.

FIG. 17 is a view showing coils in a completed state.

As shown in FIG. 17, the terminals stand upright at the middle point of the two primary coils toward outside the coils. Since the connecting portion of the terminals 2 and 3 is bent to leave the distance $\alpha$, at least an insulating distance of $2\alpha$ is left between the coils U and V. If those portions of the flat plate portions U and V where the terminals and the like are close to each other are insulated by covering, this gap can be omitted.

The coils with this terminal arrangement do not cause interference between the terminals and a magnetic core to be inserted in a winding shaft 3. Thus, the distance between the magnetic core and the terminals, and the like need not be considered. As the terminals are concentrated at substantially the center of the coils, connection between the coils and external circuits can be shortened. For example, in the case of a push-pull circuit shown in FIG. 18, an input positive terminal and a CT are connected, terminals 1 and 4 are connected to the drains of switching elements SW, and the sources of the switching elements SW and an input negative terminal are connected. The current on the primary side of this circuit forms a loop starting at the input positive terminal and returning to the input negative terminal. When the input terminals are arranged at one location, the nearer the input terminals and the terminals of a transformer 11 to each other, the shorter the current loop can be formed.

Figure 18:
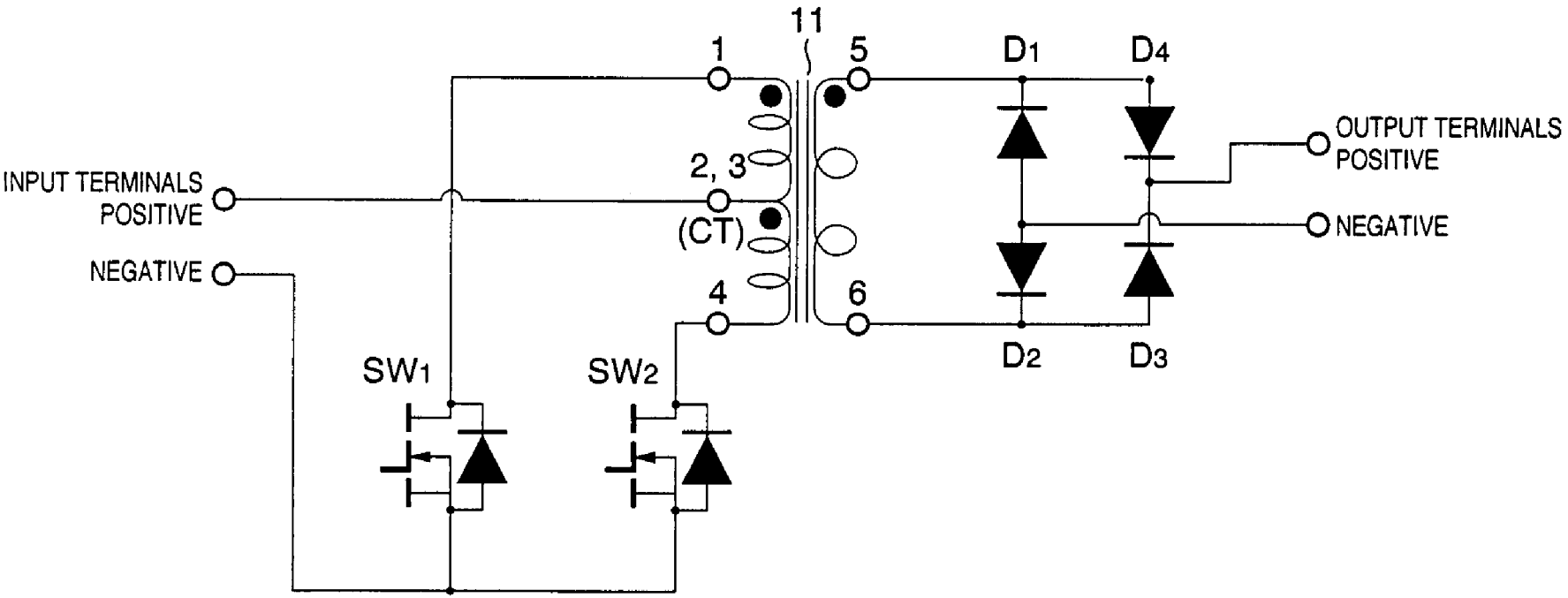
FIG. 18 is a circuit diagram showing an arrangement of a push-pull circuit.

When the push-pull circuit shown in FIG. 18 has a high step-up ratio (e.g., 1:100, 1:200, or the like) and the voltage of the primary side is very low, the current of the primary side becomes very large. In this case, to decrease the resistances of the primary coils of the transformer 11 becomes a very significant issue. Preferably, the primary coils of the transformer 11 for such application are wound at positions as close as possible to the winding shaft 3, so that their resistances may be decreased. For realizing this demand, the coils of this embodiment are suitable.

MODIFICATION

The terminals 1 and 4 may be arranged on the end faces of the coils, as in the first embodiment, or the CT may be arranged in the vicinity of the center of the coils, as in the third embodiment. When these terminals are arranged at the end faces or the center of the coils, although current distributions in the flat plate portions tend to be nonuniform, a current path is formed to start at the end face of one coil to the center, and to extend from the center to the end face of the other coil. This is effective in uniforming the current distributions in the flat plate portions. The more uniform the current distributions are, the smaller the resistances of the coils may be.

In this manner, according to these embodiments, the coils can be completed by only continuously cutting an elongated plate of a conductor to match the shape of a conductive plate, and by applying an insulating covering material to the obtained conductive plate. Thus, the conductive plate can be produced easily within a short period of time. A waste of the plate material that may occur when forming the conductive plate by cutting is minimized as much as possible, so that the plate material can be utilized effectively. When such a conductive plate is used for winding, a transformer (including an inductor having a tap) having a CT can be formed within a short period of time by only winding a single conductive plate. As a result, the winding process is simplified, and the workability is improved. Also, formation of the CT becomes unnecessary or simple, improving the workability.

Such simplification in the winding process and improvement in the workability reduce the production cost of components such as a transformer, thus facilitating automation of the production of the transformer. Since the conductive plate can be wound by utilizing the winding width of the winding shaft, on which coils are to be wound, with no waste, a measure such as forming a plurality of coils by winding to be parallel to each other, for the purpose of reducing the resistances of the coils, is unnecessary.

As many apparently widely different embodiments of the present invention can be made without departing from the spirit and scope thereof, it is to be understood that the invention is not limited to the specific embodiments thereof except as defined in the claims.

What is claimed is:

1. An electrical device comprising:

a conductor in which a plurality of plate portions are connected to each other at portions thereof, wherein at least two plate portions are formed into coils by winding said plate portions around a winding core, said plate portions to be connected to each other are arranged point-symmetrically about a connecting portion thereof, said conductor has plural terminals in positions that protrude from an area of said plate portions that is wound around the winding core, and said conductor except for the plural terminals is insulated by an insulating material layer; and an electric wire which is wound around said conductor formed into coils as a winding insulated from said conductor by the insulating material layer.

2. The device according to claim 1, wherein the connecting portion of said plate portions is utilized as a tap of said coils.

3. The device according to claim 1, wherein the connecting portion of said plate portions is utilized as a center tap of a transformer.

4. The device according to claim 1, wherein each of said plate portions has a laminated structure of a conductor and insulator.

5. The device according to claim 1, wherein each of said plate portions has at least one electrode at a position thereof corresponding to a vicinity of a center of said coils.

6. The device according to claim 1, wherein each of said plate portions has at least one electrode at a position thereof corresponding to an end of a corresponding one of said coils and a vicinity of a center of said coils.

7. A method of producing an electrical device, said method comprising steps of:

forming a conductor in which a plurality of plate portions are connected to each other at portions thereof, wherein the conductor has plural terminals;

covering the conductor except for the plural terminals with an insulating material;

forming at least two plate portions of the conductor into coils by winding the plate portions around a winding core such that the plural terminals protrude from an area of the plate portions that is wound around the winding core, wherein the plate portions to be connected to each other are arranged point-symmetrically about a connecting portion thereof; and winding an electric wire around the conductor formed into coils as a winding insulated from the conductor by the insulating material.

* * * * *